US011686314B2

(12) United States Patent
Lee et al.

(10) Patent No.: US 11,686,314 B2
(45) **Date of Patent: *Jun. 27, 2023**

(54) FAN MOTOR

(71) Applicant: LG Electronics Inc., Seoul (KR)

(72) Inventors: Jeong Ho Lee, Seoul (KR); Seong-Jae Kim, Seoul (KR); Seung Jo Baek, Seoul (KR); Young Gyu Jung, Seoul (KR); Hak Kyu Choi, Seoul (KR); Seong-Ho Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 22 days.

This patent is subject to a terminal disclaimer.

(21) Appl. No.: 17/355,516

(22) Filed: Jun. 23, 2021

(65) Prior Publication Data

US 2021/0317836 A1 Oct. 14, 2021

Related U.S. Application Data

(63) Continuation of application No. 15/923,575, filed on Mar. 16, 2018, now Pat. No. 11,085,454.

(30) Foreign Application Priority Data

Mar. 16, 2017 (KR) ..... 10-2017-0033282
Jun. 30, 2017 (KR) ..... 10-2017-0083898

(51) Int. Cl.
*F04D 25/08* (2006.01)
*F04D 29/40* (2006.01)
(Continued)

(52) U.S. Cl.
CPC ..... *F04D 25/082* (2013.01); *A47L 5/22* (2013.01); *A47L 9/22* (2013.01); *F04D 29/403* (2013.01);
(Continued)

(58) Field of Classification Search
CPC . A47L 9/22; A47L 5/22; F04D 25/082; F04D 29/26; F04D 29/403; F04D 29/444;
(Continued)

(56) References Cited

U.S. PATENT DOCUMENTS 2,294,586 A * 9/1942 Troller ..... F04D 29/5806 416/93 R
3,082,940 A * 3/1963 Frantz ..... A47L 5/24 15/329
(Continued)

FOREIGN PATENT DOCUMENTS

EP 650690 5/1995
GB 1085565 * 6/1963
(Continued)

OTHER PUBLICATIONS

EP Extended Search Report in European Appln. No. 18162170, dated Jul. 18, 2018, 7 pages.

*Primary Examiner* — Kenneth J Hansen
*Assistant Examiner* — Benjamin Doyle
(74) *Attorney, Agent, or Firm* — Fish & Richardson P.C.

(57) ABSTRACT

A fan motor for a vacuum cleaner includes a motor mount defining a cooling flow path inlet, an impeller, an impeller cover defining an air inlet, an air discharge opening defined at the motor mount and configured to discharge air to an outer space of the motor mount, and a cooling flow path outlet defined vertically above the motor mount. The cooling flow path inlet is configured to introduce air from the outer space of the motor mount into an inner space of the motor mount to cool the motor part, and the cooling flow path outlet is configured to discharge air from the inner space of the motor mount toward a space that is defined between the impeller and the air discharge opening based on the space
(Continued)

between the impeller and the air discharge opening having a lower pressure than the inner space of the motor mount.

20 Claims, 3 Drawing Sheets

(51) Int. Cl.

| | |
|---|---|
| ***F04D 29/58*** | (2006.01) |
| ***F04D 29/44*** | (2006.01) |
| ***F04D 29/26*** | (2006.01) |
| ***A47L 5/22*** | (2006.01) |
| ***F04D 29/62*** | (2006.01) |
| ***A47L 9/22*** | (2006.01) |

(52) U.S. Cl.
CPC ..... *F04D 29/444* (2013.01); *F04D 29/5806* (2013.01); *F04D 29/624* (2013.01); *F04D 29/26* (2013.01)

(58) Field of Classification Search
CPC ..... F04D 29/5806; F04D 29/624; H02K 7/14; H02K 2205/09; H02K 5/04; H02K 5/161; H02K 5/20; H02K 9/06; B08B 9/047
USPC ..... 417/423.2
See application file for complete search history.

(56) References Cited

U.S. PATENT DOCUMENTS 3,303,995 A * 2/1967 Boeckel ..... F04D 25/0606 417/423.15
4,210,833 A * 7/1980 Neveux ..... F01P 5/02 310/58
5,610,456 A * 3/1997 Wille ..... H02K 23/66 310/227
6,384,494 B1 * 5/2002 Avidano ..... H02K 9/06 310/58
6,442,792 B1 * 9/2002 Sudou ..... A47L 9/125 15/352
7,507,068 B2 * 3/2009 Lin ..... F04D 29/329 415/176
7,819,641 B2 * 10/2010 Decker ..... F04D 29/5806 417/370
7,976,292 B2 * 7/2011 Horng ..... F04D 29/601 417/423.1
8,267,674 B2 * 9/2012 Czulak ..... F04D 29/5806 417/370
9,334,868 B2 * 5/2016 Huang ..... F04D 25/082
10,638,900 B2 * 5/2020 Hayamitsu ..... F04D 25/06
2007/0147995 A1 * 6/2007 Araki ..... F04D 29/5806 415/204
2008/0193275 A1 * 8/2008 De Filippis ..... H02K 11/33 310/43
2008/0317586 A1 * 12/2008 Kuma ..... F04D 29/5806 415/203
2012/0207631 A1 8/2012 Lehman
2014/0079178 A1 3/2014 Mukumoto
2014/0328684 A1 * 11/2014 King ..... F04D 29/056 416/95
2015/0351599 A1 * 12/2015 Park ..... F04D 29/541 310/68 B
2018/0076682 A1 * 3/2018 Hwang ..... H02K 5/161
2018/0216635 A1 * 8/2018 Hayamitsu ..... F04D 25/06
2019/0365167 A1 * 12/2019 Jung ..... H02K 7/14

FOREIGN PATENT DOCUMENTS

| | | |
|---|---|---|
| GB | 1085565 | 10/1967 |
| JP | 2010124534 | 6/2010 |
| JP | 2010281232 | 12/2010 |
| JP | 06165438 | 9/2013 |
| JP | 2016223428 | 12/2016 |
| KR | 1020050097077 | 10/2005 |
| KR | 2020000004155 | 9/2008 |
| KR | 1020120067998 | 6/2012 |
| KR | 1020140145059 | 12/2014 |
| KR | 1020150140200 | 12/2015 |

* cited by examiner

FAN MOTOR

CROSS-REFERENCE TO RELATED APPLICATIONS

This application is a continuation of U.S. application Ser. No. 15/923,575, filed on Mar. 16, 2018, which claims the priority of Korean Patent Application No. 10-2017-0033282, filed on Mar. 16, 2017, and Korean Patent Application No. 10-2017-0083898, filed on Jun. 30, 2017, in the Korean Intellectual Property Office, the disclosures of which are hereby incorporated by reference in their entirety.

FIELD

The present disclosure relates to a fan motor with an integrated motor and fan, and more particularly to a fan motor structure capable of increasing power of a motor and cooling the motor smoothly while reducing the size and weight of the fan motor.

BACKGROUND

A fan motor is a device including a motor which can produce a torque, and a fan which is rotated by the motor to generate an air flow. Fan motors are widely being used for home appliances that use an air flow. A vacuum cleaner is an example of such home appliances.

A conventional vacuum cleaner may include a main body provided with a fan motor that is separated from a suction duct provided with a suction port. A handheld vacuum cleaner may include a fan motor integrated with a suction duct, which may reduce a user convenience if the fan motor is heavy.

From a standpoint of the user convenience, a lightweight fan motor may be provided for the handheld vacuum cleaner. However, the lightweight fan motor may have a problem of poor suction capability due to its low power.

Therefore, attempts have been made to increase the power of the fan motor while reducing its size and weight. A high-speed rotation of the fan motor is important for increasing the power of the fan motor while reducing its size and weight. However, the high-speed rotation may cause problems such as noise, vibration and heat generation.

In some examples, in order to cool the heat generated in the fan motor due to the high-speed rotation, some of the power of the fan motor may be used for heat dissipation of the fan motor, which may cause a problem of reduction of the motor power used for a suction force of the vacuum cleaner. In some examples where an air flow generated by the rotation of the fan motor forms a flow path to directly cool the fan motor, there may be an increase of the flow resistance at the exhaust side of the fan motor, which may deteriorate suction force of the fan motor.

SUMMARY

It is an object of the present disclosure to provide a fan r rotor structure with a reduced size and weight while maintaining its suction force.

It is another object of the present disclosure to provide a fan motor including a cooling flow path structure that can minimize reduction of motor power and fan suction force by generating an air flow for cooling heat generated in a motor part of the fan motor.

It is another object of the present disclosure to provide a fan motor structure that can simplify a process of manufacturing of a fan motor while reducing its size and weight.

Objects of the present disclosure are not limited to the above-described objects and other objects and advantages can be appreciated by those skilled in the art from the following descriptions. Further, it will be easily appreciated that the objects and advantages of the present disclosure can be practiced by means recited in the appended claims and a combination thereof.

According to one aspect of the subject matter described in this application, a fan motor for a vacuum cleaner includes a motor mount configured to accommodate a motor part, where the motor mount defines a cooling flow path inlet that is located at at least one of a lateral side or a lower side of the motor mount and that is configured to receive air to reduce heat generated in the motor part, an impeller located vertically above the motor part and configured to be rotated by the motor part, an impeller cover disposed vertically above the motor mount and configured to cover the impeller, where the impeller cover defines an air inlet at an upper central portion of the impeller cover, an air discharge opening defined at the motor mount and exposed to an outer space of the motor mount, where the air discharging opening is configured to discharge air that is suctioned through the air inlet and pressurized by the impeller to the outer space of the motor mount, and a cooling flow path outlet defined vertically above the motor mount and that is in fluid communication with an inner space of the motor mount and a space defined between the impeller and the air discharge opening. The cooling flow path inlet is configured to introduce air from the outer space of the motor mount into the inner space of the motor mount to cool the motor part, and the cooling flow path outlet is configured to discharge air from the inner space of the motor mount toward a space that is defined between the impeller and the air discharge opening based on the space between the impeller and the air discharge opening having a lower pressure than the inner space of the motor mount.

Implementations according to this aspect may include one or more of the following features. For example, the fan motor may further include a diffuser located between the impeller and a motor body part, where the impeller cover covers the diffuser and the impeller. The impeller may include a mixed-flow type fan, and the diffuser may be a mixed-flow type diffuser including an inclined surface that is inclined downward with respect to a center of the impeller. In some examples, a lower end of the diffuser may contact an upper end of the motor mount. The diffuser may include a diffuser body and a vane located on an outer surface of the diffuser body, and the outer surface of the diffuser body and an inner surface of the impeller cover may define a flow passage that allows air pressurized by the impeller to flow. The diffuser body may define the cooling flow path outlet, and the cooling flow path outlet may be positioned closer to the impeller than to the vane based on the diffuser being coupled to the impeller.

In some implementations, the diffuser body may include an inclined portion facing toward the impeller and being inclined downward with respect to the impeller, and a cylindrical portion extending downward from an outer edge of the inclined portion, where the inclined portion defines the cooling flow path outlet, and the cylindrical portion defines the vane.

In some examples, the air discharge opening may be interposed between a lower edge of the impeller cover and an upper edge of the motor mount. The motor mount may include a connecting arm that extends outward from an upper side of the motor mount and that is configured to couple the impeller cover to the motor mount. The motor mount further may include a body coupler that extends from a distal end of the connecting arm and that is configured to face the impeller cover based on the motor mount coupling to the impeller cover. The impeller cover may include a ring-shaped cover coupler at a lower edge of the impeller cover, and the body coupler may have a ring shape corresponding to the ring-shaped cover coupler.

According to another aspect, a fan motor for a vacuum cleaner includes a motor body part including a motor mount that is configured to accommodate a motor part, a diffuser disposed vertically above the motor body part, an impeller disposed vertically above the diffuser and configured to be rotated by the motor part, and an impeller cover disposed above the motor body part and configured to cover the impeller and the diffuser. An outer surface of the diffuser and an inner surface of the impeller cover define a flow passage configured to flow air pressurized by the impeller, and the diffuser defines a cooling flow path outlet configured to discharge air from the motor mount to the flow passage based on the flow passage having a lower pressure than an inner space of the motor mount.

Implementations according to this aspect may include one or more of following features. For example, the motor mount may define a cooling flow path inlet in at least one of a lateral side or a lower side of the motor mount, where the cooling flow path inlet is configured to receive air to reduce heat generated in the motor part. The motor mount may define an air discharge opening that is open toward an outer space of the motor mount and that is configured to discharge air flowing through the flow passage toward the outer space of the motor mount. A lower end of the impeller cover is located outside an upper side of the motor mount in a radial direction, and the air discharge opening may be located in a space between the lower end of the impeller and the upper side of the motor mount.

In some implementations, the diffuser may include a diffuser body defining the cooling flow path outlet, and a vane located on an outer surface of the diffuser body, where the cooling flow path outlet is positioned closer to the impeller than to the vane based on the diffuser being coupled to the impeller.

According to another aspect, a fan motor for a vacuum cleaner includes a motor body part including a motor mount that defines a cooling flow path inlet at a lower side or a lateral side of the motor mount, where the cooling flow path inlet is configured to introduce air to the motor mount, a motor part accommodated in the motor mount and configured to generate a torque, an impeller located vertically above the motor part and configured to be rotated by the torque generated by the motor part, a diffuser disposed between the impeller and the motor body part and configured to guide air pressurized by the impeller to an outer space of the motor mount, the diffuser contacting the motor body part, and an impeller cover coupled to an upper side of the motor body part and configured to cover the impeller and the diffuser, where the impeller cover defines an air inlet at an upper central portion of the impeller cover. The diffuser defines a cooling flow path outlet configured to discharge the air introduced to the motor mount to an upper space of the diffuser.

Implementations according to this aspect, the motor body part may further include a bearing housing accommodating a bearing that is coupled to the motor mount at an upper side of the motor mount and that is configured to support a shaft of the motor part, where the bearing housing is configured to seat the diffuser at an upper side of the bearing housing. The impeller cover and the motor mount may define an air discharge opening located between a lower edge of the impeller cover and an upper edge of the motor mount, and configured to discharge air pressurized by the impeller. The motor mount may include a body coupler radially spaced apart from an outer circumferential surface the motor mount at the upper edge of the motor mount, the body coupler being configured to couple to the lower edge of the impeller cover, and the air discharge opening may include a space between the outer circumferential surface of the motor mount and the body coupler.

With the fan motor structure of the present disclosure, it may be possible to maximize the power, suction force and suction efficiency of the fan motor by minimizing resistance of the downstream and outlet sides of the air flow generated by the impeller.

In addition, the number and size of components required to form the flow path for air flow can be minimized by arranging the air discharge opening for the suctioned air close to the impeller, thereby making it possible to reduce the size and weight of the product.

In addition, the air flow generated by the fan motor can be discharged to the air atmosphere rather than the motor mount having high flow resistance, without directly using the power of the motor to generate the air flow for cooling of the motor, thereby minimizing the reduction of the power of the fan motor.

In addition, since outer air having a relatively high atmospheric pressure passes through the motor to cool the motor while the air is being introduced into an air flow path of the fan motor having a relatively low pressure, it is possible to cool the motor without adding a separate component or without using the power of the motor.

The above and other effects of the present disclosure will be described below together with examples for carrying out the present disclosure.

DETAILED DESCRIPTION

Figure 1:
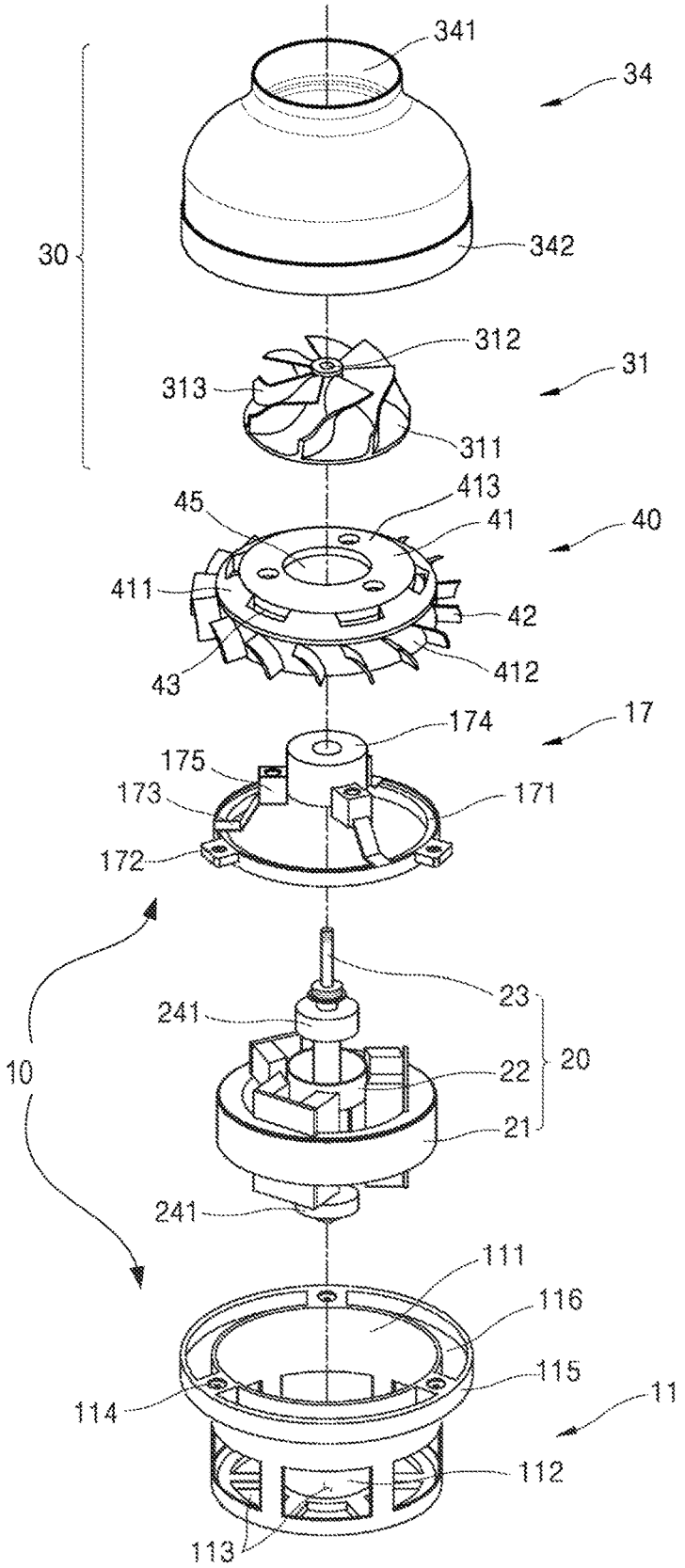
FIG. 1 is an exploded perspective view showing an example fan motor.
Figure 2:
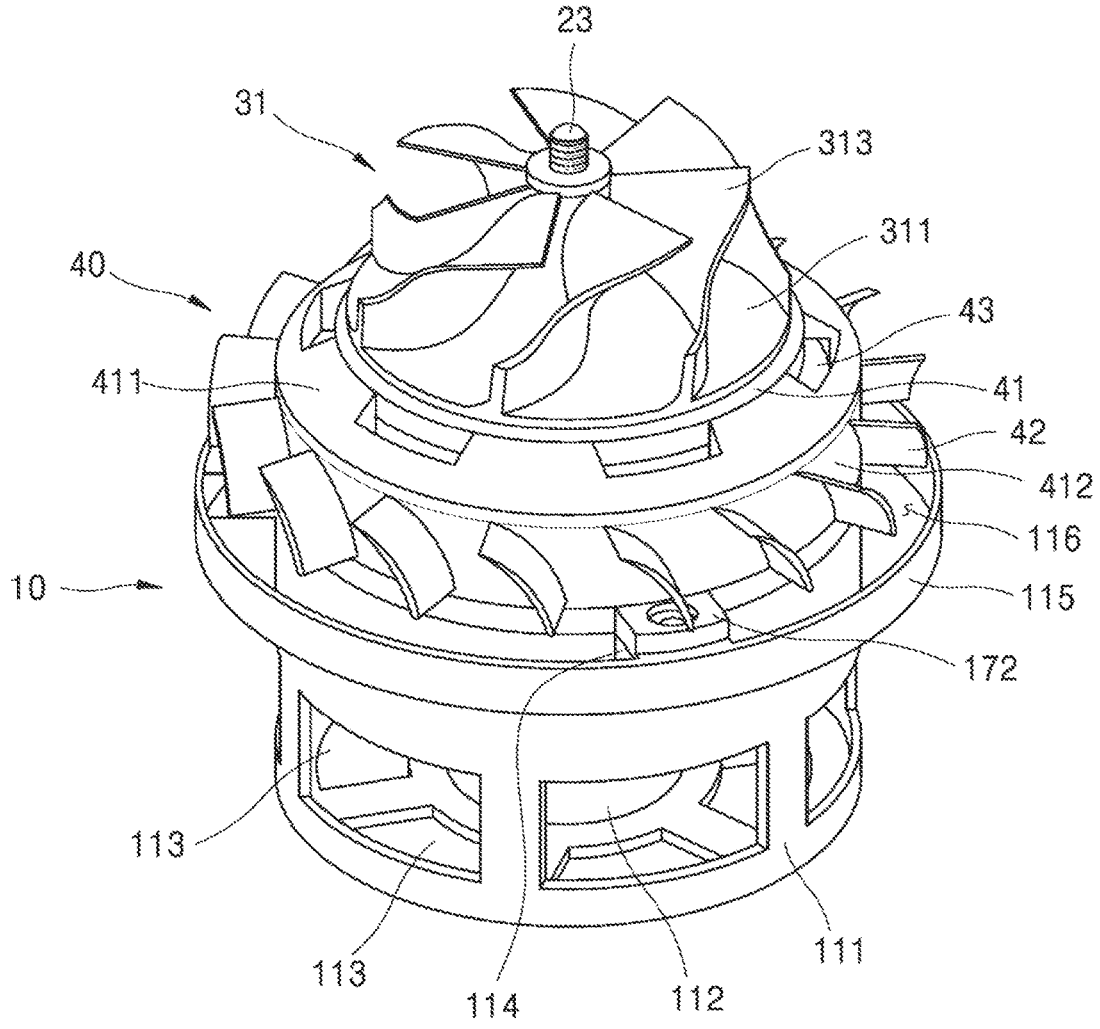
FIG. 2 is a perspective view showing the example fan motor without an impeller cover.

The above objects, features and advantages will become apparent from the detailed description with reference to the accompanying drawings. Embodiments are described in sufficient detail to enable those skilled in the art in the art to easily practice the technical idea of the present disclosure. Detailed descriptions of well-known functions or configurations may be omitted in order not to unnecessarily obscure the gist of the present disclosure. Hereinafter, implementations of the present disclosure will be described in detail with reference to the accompanying drawings. Throughout the drawings, like reference numerals refer to like elements.

<Structure of Fan Motor>

According to an implementation of the present disclosure, a fan motor includes a motor part 20, a motor body part 10 which accommodates and supports the motor part 20 and forms the entire frame of the fan motor, a flow generating part 30 which is installed above the motor body part 10 of the motor fan and generates an air flow, and a diffuser 40 which disperses the air flow generated in the flow generating part 30.

The motor part 20 includes an annular stator 21, a shaft 23 passing through the center of the stator 21, and a rotor 22 which is axially formed on the shaft 23 and generates a torque in conjunction with the stator 21. In this implementation, the motor part 20 is exemplified with a brushless direct current (BLDC) motor. Although it is illustrated in this implementation that the stator 21 is disposed outside the rotor 22 as the BLDC motor, the stator 21 may be disposed inside the rotor 22 unless contradictory.

The shaft 23 is rotatably supported by bearings 241. In this implementation, an example support structure includes a pair of bearings 241 respectively installed at both ends of the shaft 23 with the rotor 22 interposed between the pair of bearings 241. In some examples, a support structure for supporting the bearings 241 may be installed on one side of the shaft 23, for example, on the upper side of the rotor 22. In some examples, one bearing 241 may be installed on the lower side of the shaft 23 and be fixedly supported by a motor housing 11, and the other bearing 241 may be installed on the upper side of the shaft 23 and be supported by a bearing housing 17.

<Motor Body Part>

The motor body part 10 may include a motor housing 11 that accommodates the motor part 20 and that includes a body coupler 115 configured to couple to an impeller cover 34, and a bearing housing 17 that couples to the upper side of the motor housing 11 and that supports the bearings 241 installed on the upper side of the motor part 20.

The motor housing 11 may include a cylindrical motor mount 111 in which the motor part 20 is mounted, with its upper side opened, connecting arms 114 radially extending outward from the upper end of the motor mount 111, and an annular body coupler 115 provided at the end portions of the connecting arms 114 and having a diameter larger than the diameter of the motor mount 111.

A bearing support 112 for fixing and supporting the bearing 241 on the lower side of the motor part 20 may be provided at a central portion of the bottom of the motor mount 111. The bearing support 112 has a cylindrical shape with its upper side opened and the bearing 241 on the lower side of the shaft 23 is inserted into and supported by the bearing support 112 through the opened upper side of the bearing support 112.

A cooling flow path inlet 113 through which air for cooling the motor part 20 flows may be provided around the bearing support 112 at the bottom of the motor mount 111. The cooling flow path inlet 113 may be provided not only at the bottom of the motor mount 111 but also on the lower side of the side wall of the motor mount 111. The cooling flow path inlet 113 serves as a passage through which air flows from the outside of the fan motor into the motor mount 111.

A plurality of cooling flow path inlets 113 provided at the bottom of the motor mount 111 may be arranged radially as shown in the figure and a plurality of cooling flow path inlets 113 provided in the side wall of the motor mount 111 are arranged at regular intervals along the circumferential direction of the side wall. For example, the plurality of cooling flow path inlets 113 may be arranged about an axis of the motor mount 111 at an angular interval. These cooling flow path inlets 113 may be arranged in various arrangements and shapes as long as the rigidity of the bearing support 112 and the rigidity of the entire motor mount 111 can be maintained.

In examples where the side wall of the motor mount 111 supports the stator 21 embedded in the motor mount 111, it may be preferable to provide the cooling flow path inlet 113 in the side wall below a support portion of the stator 21.

As will be described later in connection with the air flow path and the motor part cooling path applied to the fan motor of this implementation, since an air discharge opening 116 of the fan motor of this implementation is located at an upper side of the motor mount 111, it may be preferable to provide the cooling flow path inlet 113 on the side wall of the motor mount 111 at a position slightly distanced from the air discharge opening 116 so as to communicate to a space as close as possible to the atmospheric pressure.

In this implementation, the cooling flow path inlet 113 may function as a passage through which the air for cooling the motor part 20 flows into the motor mount 111, while reducing the weight of the fan motor.

The side wall of the motor mount 111 has a substantially cylindrical shape and the stator 21 may be fixed to an inner surface of the side wall.

The upper end portion of the side wall of the motor mount 111 includes the connecting arms 114 extending radially from the side wall, and the body coupler 115 provided at the outer end of the connecting arms 114 in the radial direction. A space defined by the upper end portion of the side wall of the motor mount 111 and the inner surface of the body coupler 115 may serve as the air discharge opening 116 through which an air flow generated by an impeller 31 is discharged.

The upper end portion of the motor mount 111 may provide a surface on which the bearing housing 17 is seated, and the connecting arms 114 provide a coupling portion to which an outward arm 172 of the bearing housing is fixed. Further, the connecting arms 114 each may define a screw fastening hole into which the outward arm 172 can be screwed with a screw.

The number and thickness of connecting arms 114 may be appropriately selected in order to secure the flow sectional area of the air discharge opening 116 and to secure a force of coupling with the bearing housing. For example, this implementation provides a structure in which three connecting arms 114 are provided at intervals of 120 degrees.

The body coupler 115 may have a ring shape with a larger diameter than the motor mount 111. As an example of the shape of the body coupler 115, the body coupler 115 may have a cylindrical shape having a low height as shown in the figure. As another example, the body coupler 115 may have a structure similar to a flat flange. However, having the body coupler 115 in a cylindrical shape with a low height as shown in the figure can further reduce the diameter of the fan motor as a whole, which is more advantageous for miniaturization.

Figure 3:
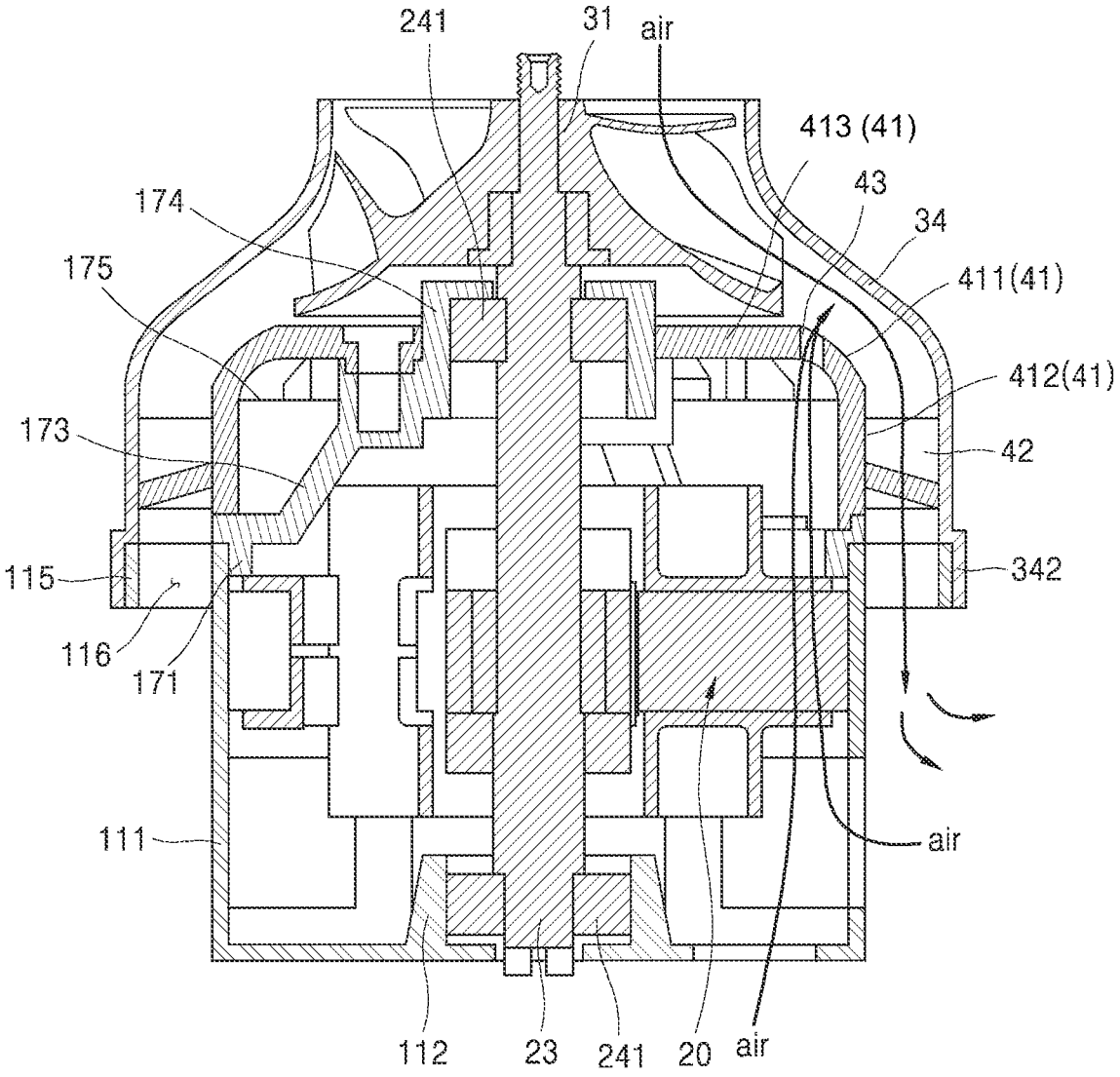
FIG. 3 is a side cross-sectional view showing the example fan motor.

As shown in FIG. 3, the body coupler 115 may be coupled around the lower end of the impeller cover 34.

<Bearing Housing>

The bearing housing 17 may be installed above the motor housing 11 in a state where the motor part 20 is accommodated in the motor housing 11. The bearing housing 17 provides a structure that supports the bearing 241 provided on the upper side of the motor part 20. In this example, the lower end of the shall 23 is supported by the motor housing 11 and the upper end of the shaft 23 is supported by the bearing housing 17 with the rotor 22 located between the lower and upper ends of the shaft 23.

Since the motor housing 11 and the bearing housing 17 support the rotor 22 and the shaft 23 that rotate at a high speed, the motor housing 11 and the bearing housing 17 may be made of a metal material having high rigidity.

In some examples, the motor housing 11 and the bearing housing 17 have a structure that precisely aligns and reliably supports the rotating shaft of the motor part rotating at a high speed. Therefore, the motor housing 11 and the bearing housing 17 are structured such that their positions are precisely regulated and fastened.

The bearing housing 17 may include a bearing support 174 at the center thereof for supporting the bearing 241 provided at the upper end of the shaft 23. The bearing support 174 may have a hollow cylindrical shape with its lower side opened and its upper central portion defining a hole through which the shaft passes. The bearing 241 may be inserted into the bearing support 174 from below.

A plurality of inward arms 173 may be arranged radially around the outer periphery of the bearing support 174. In this example, as shown in FIG. 1, three inward arms are arranged at regular intervals of 120 degrees. The inward arms 173 extend outward from the bearing support 174.

In some examples, a rectangular parallelepiped fastener 175 that is thicker than the inward arms may be provided at a portion connecting the inside of the inward arms 173 to the bearing support 174 in the radial direction. The fastener 175 is a portion where the central portion of the diffuser 40 is seated and fixed, and the fastener 175 defines a screw fastening hole for coupling the fastener 175 to the diffuser.

An annular fixer 171 fixed to the upper end of the side wall of the motor mount 111 is provided outside the inward arms 173 in the radial direction. The lower side of the fixer 171 engages with the upper side of the motor mount 111. For example, a step is formed in the lower side of the fixer 171 and engages with the upper surface and the upper inner surface of the motor mount 111. This engaging structure precisely regulates the axial and radial positions of the bearing housing 17 relative to the motor housing 11. In addition, since the step of the fixer 171 is formed toward the inner diameter side of the motor mount 111 so that the sectional area of the air discharge opening 116 located on the outer diameter side of the motor mount can be further secured.

The outward arm 172 extending radially outward is provided in the outer circumferential surface of the fixer 171. The outward arm 172 also has a screw fastening hole. The arrangement of the outward arm 172 and the screw fastening hole provided therein matches with the arrangement of the connecting arms 114 of the motor housing 11 and the screw fastening hole provided therein.

In a state where the outward arm 172 and the connecting arms 114 are aligned with each other and the fixer 171 is fitted to the upper end of the motor mount 111, when the outward arm 172 and the connecting arms 114 are screwed by a screw, the motor housing 11 and the bearing housing 17 are firmly fixed in a precisely aligned state.

The bearing housing 17 may be made of a metal material to ensure sufficient rigidity. In addition, the bearing support 174 and the fixer 171 of the bearing housing 17 are arranged to be spaced apart from each other through the inward arm 173. This arrangement contributes to reducing the weight of the bearing housing 17. As will be described later, a space formed by the bearing support 174 and the fixer 171 being separated from each other provides a path through which air which flows into the motor mount 111 through the cooling flow path inlet 113 and cools the motor part 20 can escape upward from the motor mount 111.

<Diffuser>

The diffuser 40 may be installed on the upper side of the bearing housing 17. The diffuser 40 includes a diffuser body 41 defining the overall appearance of the diffuser and vanes 42 provided on the outer surface of the diffuser body 41.

The diffuser body 41 includes a flat portion 413 having a hole 45 formed in its central portion, an inclined portion 411 inclined outwardly from the outer edge of the flat portion 413 in the radial direction, and a cylindrical portion 412 extending downward from the outer edge of the inclined portion 411.

The impeller 31 is disposed above the flat portion 413 and the lower surface of the flat portion 413 is placed on the fastener 175. The hole 45 of the flat portion 413 is formed in a shape engaging with the outer circumferential surface of the bearing support 174 and a screw fastening hole is formed in the flat portion 413 around the hole 45 at a position corresponding to the screw fastening hole of the fastener 175. In one implementation, the hole 45 may have a circular shape with its diameter corresponding to the diameter of the cylindrical bearing support 174. In this example, the inner circumferential surface of the hole 45 engages with the outer circumferential surface of the bearing support 174. In this state, the flat portion and the fastener are fixed to each other by a screw through the screw fastening hole.

The inclined portion 411 is formed at the outer edge of the flat portion 413. The inclination angle of the inclined portion 411 may correspond to the inclination angle of the impeller 31. That is, in this implementation, the impeller 31 and the diffuser 40 may be of a diagonal-flow type.

For example, the outer diameter of the cylindrical portion 412 may correspond to the outer diameter of the side wall of the motor mount 111. The lower end of the cylindrical portion 412 may be in direct or indirect close contact with the upper end of the motor mount 111. In this example, with the fixer 171 of the bearing housing 17 interposed between the motor mount 111 and the cylindrical portion 412, the lower end of the cylindrical portion 412 and the upper end of the motor mount 111 are in close contact.

In some examples, a stepped structure may be formed on the upper side of the fixer 171 of the bearing housing 17. For example, the stepped structure corresponding to the stepped structure of the fixer 171 may be formed on the lower end of the cylindrical portion 412 of the diffuser 40.

Air pressurized by the impeller 31 may flow along the outer surface of the diffuser body 41 and may be discharged to the outside through the air discharge opening 116. For example, the diffuser body 41 together with the impeller cover 34 may guide the air pressurized by the impeller 31 to the air discharge opening 116.

In order to prevent a flow of air generated by the impeller from flowing into the motor mount 111, the diffuser 40 and the motor body part 10 may be in close contact with each other. In this regard, as described above, the hole 45 and the bearing support 174 have the engaging structure, the lower end of the cylindrical portion 412 and the upper side of the fixer 171 have a step engaging structure, and the lower side of the fixer 171 and the upper side of the motor mount 111 have the step engaging structure.

The vanes 42 are provided in the lower end of the diffuser 40. The vanes 42 may guide the flow of the air pressurized and moved by the impeller 31 toward the air discharge opening 116. In this implementation, the air discharge opening 116 is defined in the upper side of the motor housing 11 and the vanes 42 are provided in the diffuser 40 above the air discharge opening 116.

In this implementation, the bearing housing 17 described above may be made of a metal material, and the diffuser 40 may be made of a synthetic resin material. The bearing housing 17 may be made of a metal material in order to secure rigidity to support the motor portion rotating at a high speed. On the other hand, in order to facilitate machining of the vanes 42 that may have a complicated shape but may not require a high rigidity because the vanes 42 function to guide the flow of air pressurized by the impeller 31, the diffuser 40 may be made of a synthetic resin material.

If the bearing housing 17 and the diffuser 40 are integrally formed, the material thereof may be a metal in order to secure the support rigidity to the motor part. However, this will result in difficulty in machining the vanes 42.

In this implementation, the bearing housing 17 and the diffuser 40 are separately made of different materials from each other according to the respective desired conditions, which may make it possible to easily machine them and reduce the weight of the product.

In this implementation, since the air discharge opening 116 is disposed on the upper side of the motor housing 11, the vanes 42 can be disposed above the motor housing 11. Therefore, it is possible to form the vanes 42 in the diffuser 40 made of synthetic resin rather in the motor housing 11 made of metal, which contributes to reducing the overall size and weight of the product.

The diffuser 40 is located below the impeller 31 and above the beating housing 17 when viewed in the vertical direction and is located outside the impeller 31 and inside the body coupler 115 when viewed in the radial direction.

In some examples, a plurality of cooling flow path outlets 43 are provided along the circumference of the inclined portion 411 of the diffuser 40. The cooling flow path outlets 43 may form a passage communicating between the upper space of the diffuser body 41 and the lower space of the diffuser body 41.

The lower space of the diffuser body 41 is a motor accommodation space defined by the bottom of the diffuser body 41 and the motor mount 111. The cooling flow path inlet 113 is provided at the bottom and the lower side of the side wall of the motor mount 111 and is opened toward a space of the air atmosphere.

Since the upper space of the diffuser body 41 is a space in which the air pressurized by the impeller 31 flows rapidly, the pressure of the upper space of the diffuser body 41 is relatively lower than the internal pressure of the motor mount 111. Due to such a pressure difference, air in the motor mount 111 flows into the upper space of the diffuser body 41 through the cooling flow path outlets 43 and then the internal space of the motor mount 111 is filled with air introduced from the cooling flow path inlet 113.

The cooling flow path outlets 43 are provided at a position closer to the impeller 31 than the vanes 42. In addition, since the cooling flow path outlets 43 are disposed close to the air discharge side of the impeller 31, a pressure difference between the upper and lower sides of the cooling flow path outlets 43 is further increased so that air for cooling the motor part 20 flows smoothly.

<Impeller>

The impeller 31 may be installed on the upper side of the diffuser 40. A shaft hole 312 through which the shaft 23 is inserted in the vertical direction may be defined at the center of the impeller 31. The shaft hole 312 may be formed in a hub or the impeller body 311 that supports the overall rigidity of the impeller 31 so that the torque of the shaft 23 can be well transferred to the impeller 31.

The impeller body 311 may include an inclined surface that is inclined downward in the radial direction from the rotational center. That is, in this implementation, the impeller 31 may be a diagonal-flow type or a mixed-flow type impeller. A plurality of blades 313 for pressing air are provided radially on the upper side of the impeller body 311.

In order to increase the suction efficiency of the impeller 31, it may be preferable that the upper end of the blades 311 has little gap with the inner surface of the impeller cover 34 which will be described below.

<Impeller Cover>

The impeller cover 34 covers the upper side of the motor body part 10. An air inlet 341 which is a passage through which air is suctioned into the fan motor is formed in the upper central side of the impeller cover 34.

The impeller cover 34 is inclined downward from the air inlet 341 as the distance from the central axis of the fan motor increases, and a cover coupler 342 is provided at the lower end of the impeller cover 34.

The cover coupler 342 has a structure that engages with the body coupler 115 of the motor body part 10. The body coupler 115 is fitted into a step of the cover coupler 342.

<Flow Path of Suctioned Air>

The fan motor having the above-described structure may suction air through the air inlet 341 provided at the upper central side of the impeller cover 34, and may discharge air through a space formed between the lower end of the impeller cover 34 and the motor mount 111, for example, through the air discharge opening 116 defined around the upper side of the motor housing 11.

The suctioned air may be pressurized by the impeller 31 and flows. The air at the output side of the impeller 31 may reach the air discharge opening 116 through an air flow path defined by the inner surface of the impeller cover 34 and the outer surface of the diffuser 40.

The impeller 31, the diffuser 40, and the impeller cover 34 are of a mixed-flow type in order to minimize the flow resistance loss of the suctioned air. In addition, the outer surfaces of diffuser body 41, the fixer 171, and the side wall of the motor mount 111 are smoothly connected to each other to minimize an air flow loss. Similarly, the inner surface of the lower end of the impeller cover 34 and the inner surface of the body coupler 115 are smoothly connected to minimize the air flow loss.

The flow of air that is expanded and decelerated through the inclined portion 411 of the diffuser 40 is redirected by the vanes 42 and discharged downward with respect to the section of the air discharge opening 116.

In this implementation, since the air discharge opening 116 is provided on the upper side of the motor housing 11, a path of flow of the suctioned air can be reduced, which leads to reduction of flow loss. Further, since the diameter of the motor housing 11 can be reduced, it is possible to further downsize the fan motor.

<Flow Path of Cooling Air>

The fan motor can rotate at an extremely high speed. In order to increase the power of the fan motor, for example, by rotating the fan motor up to about 100,000 rpm, the amount of heat generated by the motor part 20 may further increase.

A coil wound on the motor part is usually coated with enamel. If the enamel coating is melted and peeled off due to poor cooling of the motor part, the motor part is broken. In addition, when the motor part is raised to a high temperature, it affects a magnetic field, which may cause a decrease in power. Therefore, a proper cooling of the motor part is an essential factor in motor design.

In some examples where a separate cooling fan for making a flow of cooling air is provided at the lower end of the shaft 23 in order to cool the motor part 20, operating the separate cooling fan may lead to a power loss of the fan motor. That is, a method of using some of the power of the fan motor to make a cooling air flow in order to cool the heat generated in the motor part does not match the purpose of increasing speed of the fan motor. In some cases, the separate fan for cooling results in countering the downsizing of the fan motor.

In some cases, a conventional cooling structure for the suctioned air to pass through an internal space of the motor mount 111, where the motor part 20 is installed, to cool the motor part 20 may cause even higher flow loss and resistance of the downstream side of air flow than the impeller 31, which decreases the power of the fan motor.

In contrast, according to the implementation of the present disclosure, the reduction of power generated to cool the motor part is minimized by causing air to flow naturally due to a pressure difference and allowing the air to flow through a space where the motor part 20 is installed.

In the flow path of the suctioned air, the cooling flow path outlets 43 formed in the inclined portion 411 of the diffuser 40 makes a space serving as a flow path of the suctioned air to communicate with a space in which the motor part 20 is installed. The air pressurized by the impeller 31 has a very high flow velocity in the upper space of the diffuser 40 so that the pressure in the upper space of the diffuser 40 is lower than the space in which the motor part 20 is installed. This allows air to flow along a path ranging from the outside of the motor housing 11 under the atmospheric pressure, through the cooling flow path inlet 113, the space in which the motor part 20 is installed, and the space between the bearing support 174 and fixer 171 of the bearing housing 17, to the cooling flow path outlets 43.

The flow of air generated in this manner may increase with an increase in the rotational speed of the fan motor.

In some examples, the power of the fan motor may decrease even when the flow of air for cooling the motor part is induced. For example, there may be a slight power loss in flowing through the cooling flow path described above. However, it may be possible to minimize the degree of deterioration of the efficiency of the fan motor as compared with a forced flow method by a separate cooling fan or a method of passing the suctioned air through the installation space of the motor part 20. In addition, it may be possible to cool the motor part smoothly while to minimizing the deterioration of the efficiency of the fan motor.

The present disclosure described above may be variously substituted, altered, and modified by those skilled in the art to which the present disclosure pertains without departing from the scope and sprit of the present disclosure. Therefore, the present disclosure is not limited to the above-mentioned exemplary implementations and the accompanying drawings.

What is claimed is:

1. A fan motor for a vacuum cleaner, comprising:

a motor mount that accommodates a motor and defines a cooling flow path inlet at at least one of a lateral side or a lower side of the motor mount, the cooling flow path inlet being configured to receive air to reduce heat generated in the motor;

an impeller located vertically above the motor and configured to be rotated by the motor;

a diffuser located between the impeller and the motor mount; and an impeller cover that is disposed vertically above the motor mount and covers the diffuser and the impeller, the impeller cover defining an air inlet at an upper portion thereof, wherein the motor mount further defines an air discharge opening exposed to an outer space of the motor mount and configured to discharge air pressurized by the impeller to the outer space of the motor mount, wherein the diffuser comprises a diffuser body that comprises a flat portion, the flat portion covering an inner space of the motor mount from the impeller, wherein the diffuser body defines a cooling flow path outlet at a first portion of the diffuser adjacent to the impeller, the cooling flow path outlet being in fluid communication with the inner space of the motor mount and a first space defined between the impeller and the air discharge opening, and wherein the cooling flow path outlet is configured to, based on a pressure difference between the inner space of the motor mount and the first space, discharge air from the inner space of the motor mount to the first space that has a lower pressure than the inner space of the motor mount.

2. The fan motor of claim 1, wherein the diffuser body further comprises the first portion adjacent to the impeller and a second portion extending downward from the first portion.

3. The fan motor of claim 2, wherein the first portion is inclined downward with respect to a bottom surface of the impeller, and wherein the second portion extends downward from an outer edge of the first portion.

4. The fan motor of claim 3, wherein the second portion has a cylindrical shape.

5. The fan motor of claim 2, wherein the diffuser further comprises a vane located on an outer surface of the second portion, and wherein the cooling flow path outlet is defined at a position closer to the impeller than the vane.

6. The fan motor of claim 1, wherein the impeller comprises a mixed-flow type fan, and the diffuser is a mixed-flow type diffuser.

7. The fan motor of claim 1, wherein a lower end of the diffuser is in contact with an upper end of the motor mount.

8. The fan motor of claim 1, wherein an outer surface of the diffuser and an inner surface of the impeller cover define a flow passage configured to guide the air pressurized by the impeller.

9. The fan motor of claim 1, wherein the air discharge opening is defined at a position between a lower edge of the impeller cover and an upper edge of the motor mount.

10. The fan motor of claim 9, wherein the motor mount comprises a connecting arm that extends from an upper side of the motor mount and couples the impeller cover to the motor mount.

11. The fan motor of claim 10, wherein the motor mount further comprises a body coupler that extends from a distal end of the connecting arm and faces the impeller cover.

12. The fan motor of claim 11, wherein the impeller cover comprises a ring-shaped cover coupler disposed at the lower edge of the impeller cover, and wherein the body coupler has a ring shape corresponding to the ring-shaped cover coupler.

13. A fan motor for a vacuum cleaner, comprising:

a motor mount that accommodates a motor;

a diffuser disposed vertically above the motor mount;

an impeller disposed vertically above the diffuser and configured to be rotated by the motor; and an impeller cover that is disposed vertically above the motor mount and covers the impeller and the diffuser, wherein an outer surface of the diffuser and an inner surface of the impeller cover define a flow passage configured to guide air pressurized by the impeller, wherein the diffuser comprises a diffuser body that comprises a flat portion, the flat portion covering an inner space of the motor mount from the impeller, and wherein the diffuser body defines a cooling flow path outlet at a first portion of the diffuser adjacent to the impeller, the cooling flow path outlet being configured to discharge air from the inner space of the motor mount to the flow passage based on the flow passage having a lower pressure than the inner space of the motor mount by rotation of the impeller.

14. The fan motor of claim 13, wherein the motor mount defines a cooling flow path inlet at at least one of a lateral side or a lower side of the motor mount, the cooling flow path inlet being configured to receive air from an outside of the fan motor into the inner space of the motor mount to thereby reduce heat generated in the motor.

15. The fan motor of claim 13, wherein the diffuser body further comprises the first portion adjacent to the impeller and a second portion extending downward from the first portion.

16. The fan motor of claim 15, wherein the first portion is inclined downward with respect to a bottom surface of the impeller, and wherein the second portion extends downward from an outer edge of the first portion.

17. The fan motor of claim 15, wherein the diffuser further comprises a vane located on an outer surface of the second portion, and wherein the cooling flow path outlet is defined at a position closer to the impeller than the vane.

18. The fan motor of claim 13, wherein the motor mount defines an air discharge opening that is open to an outer space of the motor mount and configured to discharge the air in the flow passage to the outer space of the motor mount.

19. The fan motor of claim 18, wherein a lower end of the impeller cover is located radially outward relative to an upper side of the motor mount, and wherein the air discharge opening comprises a space between the lower end of the impeller cover and the upper side of the motor mount.

20. A fan motor for a vacuum cleaner, comprising:

a motor body part comprising a motor mount that defines a cooling flow path inlet at a lower side or a lateral side of the motor mount, the cooling flow path inlet being configured to introduce air to the motor mount;

a motor accommodated in the motor mount and configured to generate a torque;

an impeller located vertically above the motor and configured to be rotated by the torque generated by the motor;

a diffuser that is in contact with the motor body part and disposed between the impeller and the motor body part, the diffuser being configured to guide air pressurized by the impeller to an outer space of the motor mount; and an impeller cover that is coupled to an upper side of the motor body part and covers the impeller and the diffuser, the impeller cover defining an air inlet at an upper portion thereof, wherein the diffuser comprises a flat portion that covers an inner space of the motor mount from the impeller, and wherein the diffuser defines a cooling flow path outlet at a first portion of the diffuser adjacent to the impeller, the cooling flow path outlet being configured to discharge the air introduced to the motor mount to an upper space defined between the diffuser and the impeller cover.

* * * * *